US011752445B1

(12) United States Patent
Purnell

(10) Patent No.: US 11,752,445 B1
(45) Date of Patent: Sep. 12, 2023

(54) PATTERN PRODUCING CARDS AND METHODS OF USE THEREOF

(71) Applicant: Penguin Magic, Inc., Rancho Cordova, CA (US)

(72) Inventor: Kyle Purnell, Boiling Springs, PA (US)

(73) Assignee: Penguin Magic, Inc., Rancho Cordova, CA (US)

( * ) Notice: Subject to any disclaimer, the term of this patent is extended or adjusted under 35 U.S.C. 154(b) by 0 days.

(21) Appl. No.: 18/094,114

(22) Filed: Jan. 6, 2023

(51) Int. Cl.
*A63J 21/00* (2006.01)

(52) U.S. Cl.
CPC ..... *A63J 21/00* (2013.01)

(58) Field of Classification Search
CPC .. A63J 21/00; A63J 25/00; A63J 99/00; A63F 9/00
See application file for complete search history.

(56) References Cited

U.S. PATENT DOCUMENTS 6,874,785 B2 * 4/2005 Miller ..... A63F 1/02 273/293
8,333,645 B2 * 12/2012 Xidos ..... G07F 17/3293 463/17
2002/0024179 A1 * 2/2002 Chida ..... A63F 1/02 273/307
2002/0092908 A1 * 7/2002 Chumbley ..... G07C 13/00 235/386
2003/0184016 A1 * 10/2003 Miller ..... A63F 1/02 273/307
2004/0188939 A1 * 9/2004 Green ..... A63F 1/02 273/292
2007/0252332 A1 * 11/2007 Cassidy ..... A63H 33/044 273/292
2010/0184508 A1 * 7/2010 Xidos ..... G07F 17/32 463/26
2010/0308540 A1 * 12/2010 Williams ..... A63F 1/02 273/295
2014/0228137 A1 * 8/2014 Zealer ..... A63J 5/02 472/68

* cited by examiner

*Primary Examiner* — Sisay Yacob
(74) *Attorney, Agent, or Firm* — Polsinelli PC

(57) ABSTRACT

A magic kit and methods of use thereof is described. The magic kit may have a set of cards, each card comprising a plurality of holes and an order marker. The plurality of holes on each card are arranged in a different order. When the set of cards are stacked on top of each other in a specific order, using the order markers as guides, only some of the holes of all the cards in the set align to form a pattern.

29 Claims, 4 Drawing Sheets

PATTERN PRODUCING CARDS AND METHODS OF USE THEREOF

FIELD

The present disclosure relates generally to a magic kit with a set of cards to be used to display a pattern, such as a number or series of numbers. In at least one example, each card has a plurality of holes and an order marker. When the order markers are used to stack the set of cards in a specific order, some of the holes in each card align producing a pattern.

BACKGROUND

Magicians have great interest in surprising observers. The magician may want to have a set of cards capable of producing a number. A magician may want to ask an observer to think of a number and write it down. The magician may use common tricks to figure out what the observer's chosen number is. The magician may then want to produce the observer's number using a set of cards, surprising the observer by making them think the cards are capable of reading the observer's mind.

As presented herein, a magic kit has been developed to overcome these problems.

BRIEF SUMMARY

Provided herein is a magic kit comprising a set of cards operable to produce a pattern when arranged in a specific order. The magic kit may include a set of cards, each card having a plurality of holes and a unique order marker.

An aspect of the present disclosure provides a magic kit comprising: a set of cards, each card comprising a plurality of holes and an order marker. The plurality of holes on each card are arranged in a different order. When the cards are stacked on top of each other in a specific order, using the order markers as guides, only some of the holes of all the cards in the set align to form a pattern.

In some aspects, the set of cards comprises at least four cards. In other aspects, the set of cards comprises four, five, or six cards. The cards have a length from about 80 millimeters (mm) to about 90 mm and a width from about 60 mm to about 70 mm. The cards have a thickness from about 0.5 mm to about 1.5 mm.

The plurality of holes are substantially uniform in size. In other aspects, the plurality of holes are uniform in size. The holes are laser cut into the cards. In some aspects, each card has a minimum of 40 holes. In other aspects, each card has 40 to 80 holes. Each card in the set may have a different number of holes than the other cards in the set, or each card in the set may have the same number of holes as the other cards in the set. For example, each card may have 66 holes.

In additional aspects, the holes have a polygonal shape. The holes may have the shape of a circle, oval, square, triangle, pentagon, hexagon, heptagon, or octagon. For example, the holes may have the shape of a circle and have a diameter from about 1 mm to about 5 mm and a thickness from about 0.5 mm to about 1.5 mm. In further aspects, the holes may have a length from about 1 mm to about 5 mm, a width from about 1 mm to about 5 mm, and a thickness from about 0.5 mm to about 1.5 mm.

In some aspects, each card may be comprised of a material that is not light transparent, such as acrylic. Each card may be opaque and block light from traveling through it in the areas devoid of holes or not fully aligned holes.

In additional aspects, the pattern may have the appearance of a number from 0 to 9. In further aspects, the pattern may have the appearance of a number from 1 to 9. The pattern of aligned holes may be changed by rotating one or more cards 180 degrees about a center axis when stacked. For example, when the cards are not stacked in a specific order, no holes will align.

In additional aspects, the magic kit may have a second set of cards. The second set of cards may have at least four cards. For example, the second set of cards may have four, five, or six cards. The aligned holes of the first set of cards can form a number from 0 to 9 and the aligned holes of the second set of cards can form a number from 0 to 9, such that the first set of cards and the second set of cards can be used to form a two-digit number.

Further provided herein is a method for performing a magic trick comprising: presenting a set of cards, each card comprising a plurality of holes and an order marker, wherein the plurality of holes on each card are arranged in a different order; stacking the set of cards on top of each other in a specific order, using the order markers as guides; and forming a pattern of aligned holes from all the cards in the set, wherein only some of the holes of all the cards in the set align to form the pattern.

In some aspects, the set of cards comprises four cards. Each card may have about 40 holes to about 80 holes. For example, the holes may have the shape of a circle, oval, square, triangle, pentagon, hexagon, heptagon, or octagon.

In some aspects, each card is comprised of a material that is not light transparent. For example, the cards may be made of acrylic. Each card may be opaque and block light from traveling through the areas devoid of holes or not fully aligned holes.

In an aspect, the pattern has the appearance of a number from 0 to 9. In at least one aspect, rotating one or more cards 180 degrees about a center axis when stacked changes the pattern of the aligned holes. For example, if the cards are not stacked in a specific order, no holes will align.

In an additional aspect, the method includes a second set of cards. The second set of cards may comprise at least four cards. The aligned holes of the first set of cards can form a number from 0 to 9 and the aligned holes of the second set of cards can form a number from 0 to 9, such that the first set of cards and the second set of cards can be used to form a two-digit number.

Other aspects and iterations of the invention are described more thoroughly below.

DETAILED DESCRIPTION

Figure 1A:
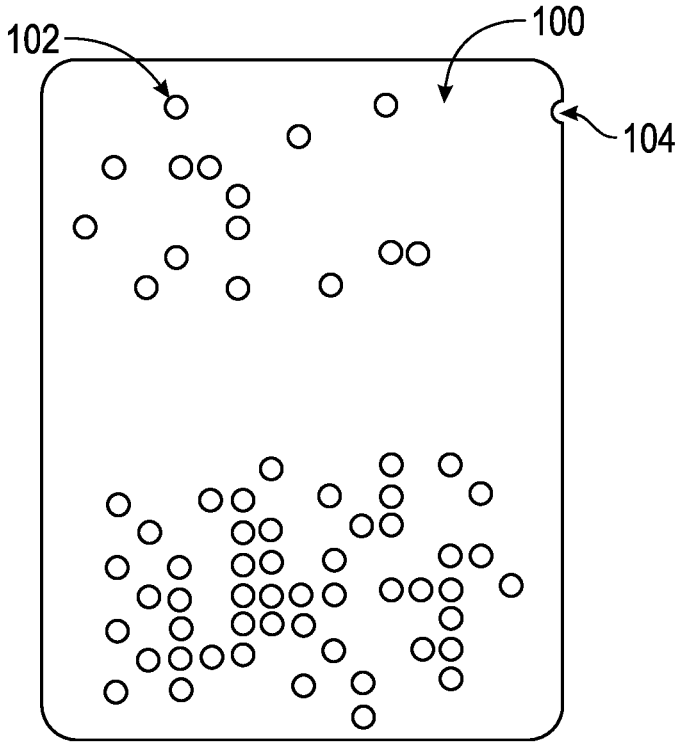
FIG. 1A is a front view of an example card.

It will be appreciated that for simplicity and clarity of illustration, where appropriate, reference numerals have been repeated among the different figures to indicate corresponding or analogous elements. In addition, numerous specific details are set forth in order to provide a thorough understanding of the examples described herein. However, it will be understood by those of ordinary skill in the art that the examples described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout the above disclosure will now be presented. As used herein, "about" refers to numeric values, including whole numbers, fractions, percentages, etc., whether or not explicitly indicated. The term "about" generally refers to a range of numerical values, for instance, ±0.5-1%, ±1-5% or ±5-10% of the recited value, that one would consider equivalent to the recited value, for example, having the same function or result.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, "substantially cylindrical" means that the object resembles a cylinder but can have one or more deviations from a true cylinder.

The terms "comprising," "including" and "having" are used interchangeably in this disclosure. The terms "comprising," "including" and "having" mean to include, but not necessarily be limited to the things so described.

Provided herein is a magic kit for use in magic tricks. The magic kit includes at least one set of cards. Each card has a plurality of holes and a unique identifying order marker. When a set of cards is stacked in a specific order, using the order markers as guides, some of the holes in the cards align to form a pattern. The pattern may be in the shape of a number or other pattern. Magicians will be able to use this magic kit to produce numbers or other patterns for observers.

Figure 1B:
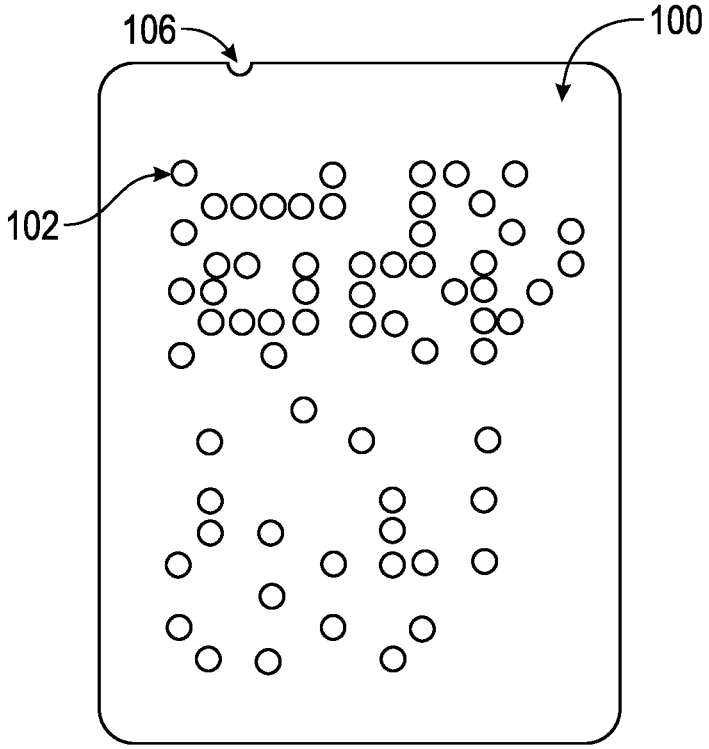
FIG. 1B is a front view of an example card.

FIGS. 1A and 1B show an example card 100. In an embodiment, the card 100 may include a plurality of holes 102 and either a side order marker 104 or a top order marker 106. The plurality of holes 102 on each card 100 may be arranged in a different order. The plurality of holes 102 are substantially uniform in size. The holes 102 have the shape of a circle. The holes 102 have a diameter from about 1 mm to about 5 mm. The side order marker 104 is in the shape of a semi-circle cut out on the side of the card 100. The top order marker 106 is in the shape of a semi-circle cut out on the top of the card 100.

In another embodiment, the side order markers 104 and the top order markers 106 may be a slot cut into the edge of a card 100. The side order markers 104 and the top order markers 106 may be in a different location on different cards. In other examples, the order markers 104 and 106 may be extrusions from each card. In at least one example, each card 100 may have only one order marker 104 or 106. In another example, the order markers 104 and 106 may be any marking that allows the magician to order the cards. In a further example, the order markers 104 and 106 may not be readily visible to an observer.

The card 100 may be made of a material that is not light transparent. In an example, the card 100 may be made of a material that is partially light transparent. In at least one example, the card 100 is made of acrylic. In further examples, the card 100 may be made of metal or plastic. The card 100 may be opaque and block light from traveling through it in the areas devoid of holes or holes that are not fully aligned within a stack of cards.

The card 100 may have a length from about 80 millimeters (mm) to about 90 mm. In some embodiments, the card 100 may have a length of about 50 mm, about 55 mm, about 60 mm, about 65 mm, about 70 mm, about 75 mm, about 80 mm, about 85 mm, about 90 mm, about 95 mm, about 100 mm, about 105 mm, about 110 mm, about 115 mm, about 120 mm, or about 125 mm.

The card 100 may have a width from about 60 mm to about 70 mm. In some embodiments, the card 100 may have a width of about 50 mm, about 55 mm, about 60 mm, about 65 mm, about 70 mm, about 75 mm, about 80 mm, about 85 mm, about 90 mm, about 95 mm, or about 100 mm.

The card 100 may have a thickness from about 0.5 mm to 1.5 mm. In some embodiments, the card 100 may have a thickness of about 0.5 mm, about 0.6 mm, about 0.7 mm, about 0.8 mm, about 0.9 mm, about 1.0 mm, about 1.1 mm, about 1.2 mm, about 1.3 mm, about 1.4 mm, or about 1.5 mm.

In an embodiment, the plurality of holes 102 are uniform in size. In at least one example, the holes 102 are not uniform in size. In at least one example, the holes 102 are laser cut in the cards 100. The holes 102 may be machined into the cards 100. Any manufacturing technique may be used to create the plurality of holes 102 in the cards 100. In an example, each card 100 may have a minimum of 40 holes. In another example, each card 100 may have about 20 holes to 40 holes, 30 holes to 50 holes, 40 holes to about 80 holes, about 50 holes to 70 holes, 60 holes to 80 holes, or 70 holes to 90 holes. In a further example, each card 100 may have more than 20 holes. In at least one example, the card 100 has 66 holes.

In some examples, the holes 102 have the shape of a circle, oval, square, triangle, pentagon, hexagon, heptagon, octagon, or other shape. In other examples, the holes 102 have a polygonal shape. The holes 102 may have a length from about 1 mm to 5 mm, about 1 mm to 3 mm, about 2 mm to 4 mm, or about 3 mm to 5 mm. The holes may have a width from about 1 mm to 5 mm, about 1 mm to 3 mm, about 2 mm to 4 mm, or about 3 mm to 5 mm. In some examples, the length and width may be a diameter of a circle. The holes may have a thickness from about 0.5 mm to 1.5 mm, about 0.6 mm, about 0.7 mm, about 0.8 mm, about 0.9 mm, about 1.0 mm, about 1.1 mm, about 1.2 mm, about 1.3 mm, about 1.4 mm, or about 1.5 mm. The thickness of the holes 102 may be the same as the thickness of the card 100 such that the holes 102 extend through the full thickness of the card 100.

Figure 2:
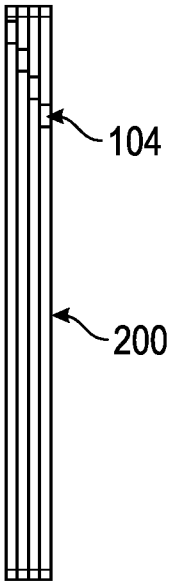
FIG. 2 is a side view of an example card set.
Figure 4:
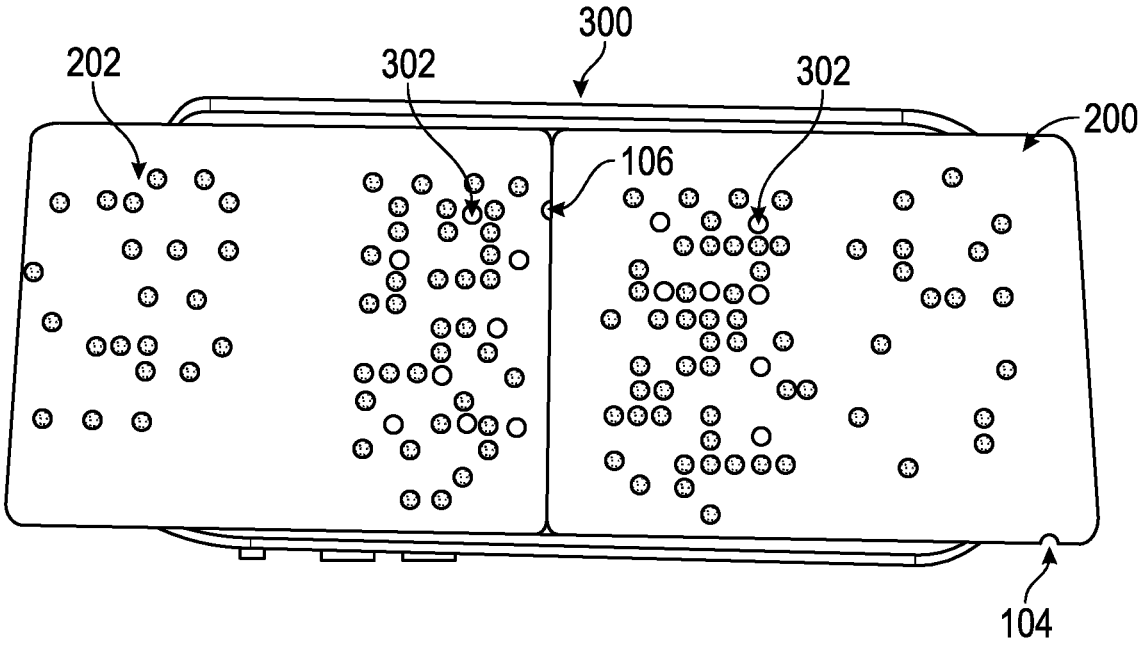
FIG. 4 is a view of an example magic kit.

In some embodiments, the magic kit may include a first set of cards 200. Referring to FIG. 2 and FIG. 4, the first set of cards 200 may have side order markers 104. For example, each card 100 in the first set of cards 200 may have one side order marker 104. The side order marker 104 may be in a different longitudinal location along a longitudinal side of each card 100. The variation in the location of the side order marker 104 on each card 100 may allow for easily identifying the order of the cards in the set. For example, the side order markers 104 may be organized in a descending order, with the first side order marker 104 being nearest to the top on the first card and the last side order marker 104 being nearest to the bottom on the last card. The first set of cards 200 may be stacked in a specific order, using the side order markers 104 as guides, to align some holes of all of the cards in the set to form a pattern 302. For example, the pattern 302 may be changed by rearranging the order and orientation of the side order markers 104 in the stacked first set of cards 200.

In some embodiments, the set of cards may have two, three, four, five, or six cards. In at least one example, the set of cards has at least two cards. The set of cards may have more than six cards. In an embodiment, the first set of cards 200 may include four cards.

In an embodiment, each card in the first set may have a different number of holes than one or more cards in the set. In another embodiment, each card in the first set may have the same number of holes as the other cards in the set. For example, each card in the first set of cards may have 66 holes.

The first set of cards 200 may be stacked in a specific order to align some holes of all of the cards in the set to form a pattern 302. In an embodiment, the pattern 302 produced by the first set of cards 200 may be a number from 0 to 9. In an example, the pattern 302 produced by the first set of cards 200 may be a number from 1 to 9. Only the holes that align in all cards of the first set of cards may form the shape of a number. For example, connecting the aligned holes would form a number and may be mentally done by an observer. In a further example, the pattern 302 may be any other pattern. The number or pattern may change by rotating one or more cards 180 degrees. The combination of rotating one or more cards may allow for the holes to align to form each number from 1 to 9.

Figure 3:
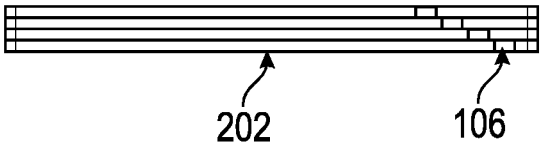
FIG. 3 is a top view of an example card set.

In some embodiments, the magic kit may include a second set of cards 202. Referring to FIG. 3 and FIG. 4, the second set of cards 202 may have top order markers 106. For example, each card 100 in the second set of cards 202 may have one top order marker 106. The top order marker 106 may be in a different longitudinal location along a top or bottom side of each card 100. The variation in the location of the top order marker 106 on each card 100 may allow for easily identifying the order of the cards in the set. In an example, the top order markers 106 may be organized in a descending order, with the first top order marker 106 being furthest to the left on the first card and the last top order marker 106 being furthest to the right on the last card in the set. In an example, the second set of cards 202 has four cards. The second set of cards 202 may be stacked in a specific order, using the top order markers 106 as guides, to align some holes of all of the cards in the set to form a pattern 302. For example, the pattern 302 may be changed by rearranging the order and orientation of the top order markers 106 in the stacked second set of cards 202.

In some embodiments, the second set of cards may have two, three, four, five, or six cards. In at least one example, the second set of cards has at least two cards. In a further example, the second set of cards may have more than six cards. . In an embodiment, the second set of cards 202 may include four cards.

In an embodiment, each card in the second set may have a different number of holes than the other cards in the second set. In another embodiment, each card in the second set may have the same number of holes as the other cards in the second set. For example, each card in the second set of cards may have 66 holes.

The second set of cards 202 may be stacked in a specific order to align some holes of all of the cards in the set to form a pattern 302. In an embodiment, the pattern 302 produced by the second set of cards 202 may be a number from 0 to 9. For example, the pattern 302 produced by the second set of cards 202 may be a number from 1 to 9. Only the holes that align in all cards of the second set of cards may form the shape of a number. For example, connecting the aligned holes would form a number and may be mentally done by an observer. In a further example, the pattern 302 may be any other pattern. The number or pattern may change by rotating one or more cards 180 degrees. The combination of rotating one or more cards may allow for the holes to align to form each number from 1 to 9.

Referring to FIG. 4, the magic kit 300 includes two sets of cards, e.g. a first set of cards 200 and a second set of cards 202. The top markers 106 may be used to arrange the cards in the second set of cards 202 in an order to align some of the holes 102 to produce a pattern 302. The side order markers 104 are used to arrange the cards in the first set of cards 200 in an order to align some of the holes 102 to produce a pattern 302. The pattern formed from the stacked first set of cards and the patter formed from the stacked second set of cards may be the same or different pattern. For example, then the first set of cards 200 and the second set of cards 202 are put together (e.g. next to one another as seen in FIG. 4) they produce a combined pattern, such as a two-digit number. In another embodiment, the pattern 302 may be a single digit number from 0 to 9. In a further embodiment, the pattern 302 may be a three-digit number. In other embodiments, the pattern 302 may be any type of pattern.

In some embodiments, a light, such as a cellphone, may be used to light up the pattern 302. This may allow for the pattern to be more visible to an observer, with only the aligned holes passing light through the stacked cards.

Referring to FIG. 4, the pattern 302 of aligned holes may be changed by rotating one or more cards 180 degrees about a center axis when stacked. For example, each rotation may correspond to a different pattern 302. In an embodiment, if the cards are not stacked properly the holes 102 will not align and no pattern 302 will be produced.

Further provided herein is a method for performing a magic trick. The method may include presenting a set of cards, stacking the set of cards on top of each other in a specific order; and forming a pattern of aligned holes from all the cards in the set. In an embodiment, each card may include a plurality of holes and an order marker. The plurality of holes on each card are arranged in a different order and the order markers may be used as guides when stacking the set of cards. In some embodiments, only some of the holes of all the cards in the set align to form a pattern.

Figure 5:
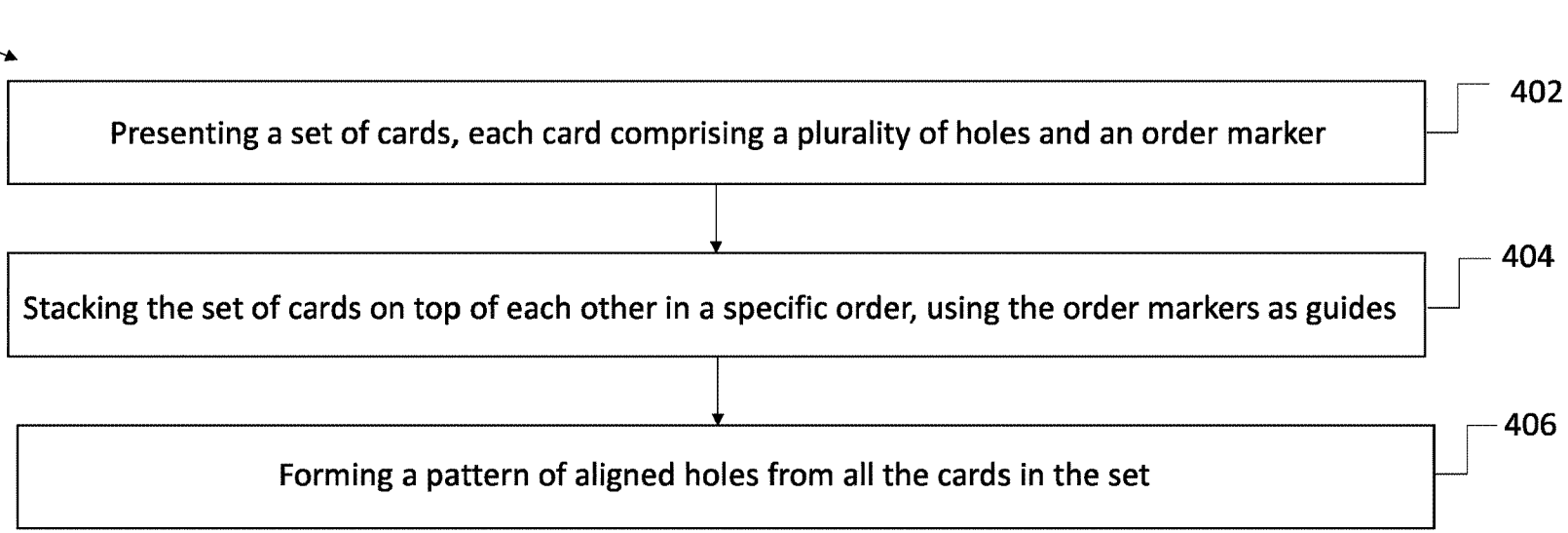
FIG. 5 is an example flowchart of the method for performing a magic trick.

A flowchart as seen in FIG. 5 is presented in accordance with an example embodiment. The method 400 is provided by way of example, as there are a variety of ways to carry out the method. The method 400 described below can be carried out using the configurations illustrated in the figures, for example, and various elements of these figures are referenced in explaining example method 400. Each block represents one or more processes, methods or subroutines, carried out in the example method 400. Furthermore, the illustrated order of blocks in FIG. 5 is illustrative only and the order of the blocks can change according to the present disclosure. Additional blocks may be added, or fewer blocks may be utilized, without departing from this disclosure.

The example method 400 is a method for performing a magic trick. The example method can begin at block 402. At block 402, the method includes presenting a set of cards, each card having a plurality of holes and an order marker. The plurality of holes on each card are arranged in a different order. In some embodiments, the set of cards may have at least four cards. The set of cards may have four, five, or six cards.

At block 404, the method includes stacking the set of cards on top of each other in a specific order, using the order markers as guides. For example, different orders and orientations of order markers have a different effect on the magic trick and produce a different pattern. In some embodiments, this step may include stacking a first set of cards and stacking a second set of cards to form two stacks of cards.

At block 406, the method includes forming a pattern of aligned holes from at least some of the cards in the set. In at least one example, only some of the holes in all of the cards will align to form a pattern. For example, rotating one or more of the cards 180 degrees about a center axis changes which holes in each card align thereby changing the pattern. In at least one example, if the cards are not stacked in a specific order no holes will align and no pattern will be formed. In an embodiment, the first set of cards is arranged, using the order markers as guides, to align the plurality of holes to produce a pattern. Further, the second set of cards is arranged, using the order markers as guides, to align the plurality of holes to produce a pattern. In an example, the pattern produced may be a number from 0 to 9. In another example, the pattern produced may be a number from 1 to 9. In an embodiment, a first set of cards may be stacked to form a first pattern of aligned holes and a second set of cards may be stacked to form a second pattern. In an example, the first pattern may be a number from 1 to 9 and the second number may be a number 1 to 9, such that the first pattern and the second pattern may be combined (e.g. pushed up next to each other) to form a two digit number. For example, FIG. 4 shows a first set of cards with aligned holes forming a 2 and a second set of cards with aligned holes forming a 4.

After the patters are formed, a light may be shown through the aligned holes in the first set of cards and the second set of cards to illuminate a two-digit number. For example, at least a portion of each stack of cards may be placed on a digital device to illuminate the aligned holes in each stack of cards. The digital device may be a phone, tablet, or any other device capable or providing a light source. The digital device may be set to display a solid color, such as white.

In a further embodiment, a magician may ask an observer to pick a number. The magician may then use the magic kit presented herein to produce the observer's number.

The disclosures shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the examples described above may be modified within the scope of the appended claims.

Exemplary Embodiments

Embodiment 1: A magic kit comprising: a set of cards, each card comprising a plurality of holes and an order marker, wherein the plurality of holes on each card are arranged in a different order, wherein when the set of cards are stacked on top of each other in a specific order, using the order markers as guides, only some of the holes of all the cards in the set align to form a pattern.

Embodiment 2: the magic kit of embodiment 1, wherein the set of cards comprises at least four cards.

Embodiment 3: the magic kit of embodiment 1, wherein the set of cards comprises four, five, or six cards.

Embodiment 4: The magic kit of embodiment 1, wherein the cards have a length from about 80 millimeters (mm) to about 90 mm and have a width from about 60 mm to about 70 mm.

Embodiment 5: The magic kit of embodiment 1, wherein the cards have a thickness from about 0.5 mm to about 1.5 mm.

Embodiment 6: The magic kit of embodiment 1, wherein the plurality of holes are substantially uniform in size.

Embodiment 7: The magic kit of embodiment 6, wherein the plurality of holes are uniform in size.

Embodiment 8: The magic kit of embodiment 1, wherein the holes are laser cut in the cards.

Embodiment 9: The magic kit of embodiment 1, wherein each card has a minimum of 40 holes.

Embodiment 10: The magic kit of embodiment 1, wherein each card has about 40 holes to about 80 holes.

Embodiment 11: The magic kit of embodiment 1, wherein each card in the set has a different number of holes than the other cards in the set.

Embodiment 12: The magic kit of embodiment 1, wherein each card in the set has the same number of holes as the other cards in the set.

Embodiment 13: The magic kit of embodiment 12, wherein each card has 66 holes.

Embodiment 14: The magic kit of embodiment 1, wherein the holes have a polygonal shape.

Embodiment 15: The magic kit of embodiment 1, wherein the holes have the shape of a circle, oval, square, triangle, pentagon, hexagon, heptagon, or octagon.

Embodiment 16: The magic kit of embodiment 1, wherein each of the plurality of holes has the shape of a circle and a diameter from about 1 mm to about 5 mm.

Embodiment 17: The magic kit of embodiment 1, wherein the holes have a thickness from about 0.5 mm to about 1.5 mm.

Embodiment 18: The magic kit of embodiment 1, wherein the holes have a length from about 1 mm to about 5 mm, a width from about 1 mm to about 5 mm, and a thickness from about 0.5 mm to about 1.5 mm.

Embodiment 19: The magic kit of embodiment 1, wherein each card is comprised of a material that is not light transparent.

Embodiment 20: The magic kit of embodiment 1, wherein the cards are made of acrylic.

Embodiment 21: The magic kit of embodiment 1, wherein each card is opaque and blocks light from traveling through it in the areas devoid of holes or not fully aligned holes.

Embodiment 22: The magic kit of embodiment 1, wherein the pattern has the appearance of a number from 0 to 9.

Embodiment 23: The magic kit of embodiment 22, wherein the pattern has the appearance of a number from 1 to 9.

Embodiment 24: The magic kit of claim 1, wherein rotating one or more cards 180 degrees about a center axis when stacked changes the pattern of the aligned holes.

Embodiment 25: The magic kit of embodiment 1, wherein if the cards are not stacked in the specific order, no holes will align.

Embodiment 26: The magic kit of embodiment 1, further comprising a second set of cards.

Embodiment 27: The magic kit of embodiment 26, wherein the second set of cards comprises at least four cards.

Embodiment 28: The magic kit of embodiment 26, wherein the second set of cards comprises four, five, or six cards.

Embodiment 29: The magic kit of embodiment 26, wherein the aligned holes of the first set of cards can form a number from 0 to 9 and the aligned holes of the second set of cards can form a number from 0 to 9, such that the first set of cards and the second set of cards can be used to form a two digit number.

Embodiment 30: A method of performing a magic trick, the method comprising: presenting a set of cards, each card comprising a plurality of holes and an order marker, wherein the plurality of holes on each card are arranged in a different order; stacking the set of cards on top of each other in a specific order, using the order markers as guides; and forming a pattern of aligned holes from all the cards in the set, wherein only some holes of all the cards in the set align to form the pattern.

Embodiment 31: The method of embodiment 30, wherein the set of cards comprises at least four cards.

Embodiment 32: The method of embodiment 30, wherein the set of cards comprises four, five, or six cards.

Embodiment 33: The method of embodiment 30, wherein the cards have a length from about 80 millimeters (mm) to about 90 mm and have a width from about 60 mm to about 70 mm.

Embodiment 34: The method of embodiment 30, wherein the cards have a thickness from about 0.5 mm to about 1.5 mm.

Embodiment 35: The method of embodiment 30, wherein the plurality of holes are substantially uniform in size.

Embodiment 36: The method of embodiment 30, wherein the plurality of holes are uniform in size.

Embodiment 37: The method of embodiment 30, wherein the holes are laser cut in the cards.

Embodiment 38: The method of embodiment 30, wherein each card has a minimum of 40 holes.

Embodiment 39: The method of embodiment 30, wherein each card has about 40 holes to about 80 holes.

Embodiment 40: The method of embodiment 30, wherein each card in the set has a different number of holes than the other cards in the set.

Embodiment 41: The method of embodiment 30, wherein each card in the set has the same number of holes as the other cards in the set.

Embodiment 42: The method of embodiment 41, wherein each card has 66 holes.

Embodiment 43: The method of embodiment 30, wherein the holes have a polygonal shape.

Embodiment 44: The method of embodiment 30, wherein the holes have the shape of a circle, oval, square, triangle, pentagon, hexagon, heptagon, or octagon.

Embodiment 45: The method of embodiment 30, wherein each of the plurality of holes has the shape of a circle and a diameter from about 1 mm to about 5 mm.

Embodiment 46: The method of embodiment 30, wherein the holes have a thickness from about 0.5 mm to about 1.5 mm.

Embodiment 47: The method of embodiment 30, wherein the holes have a length from about 1 mm to about 5 mm, a width from about 1 mm to about 5 mm, and a thickness from about 0.5 mm to about 1.5 mm.

Embodiment 48: The method of embodiment 30, wherein each card is comprised of a material that is not light transparent.

Embodiment 49: The method of embodiment 30, wherein the cards are made of acrylic.

Embodiment 50: The method of embodiment 30, wherein each card is opaque and blocks light from traveling through it in the areas devoid of holes or not fully aligned holes.

Embodiment 51: The method of embodiment 30, wherein the pattern has the appearance of a number from 0 to 9.

Embodiment 52: The method of embodiment 51, wherein the pattern has the appearance of a number from 1 to 9.

Embodiment 53: The method of embodiment 30, wherein rotating one or more cards 180 degrees about a center axis when stacked changes the pattern of the aligned holes.

Embodiment 54: The method of embodiment 30, wherein if the cards are not stacked in the specific order, no holes will align.

Embodiment 55: The method of embodiment 30, further comprising a second set of cards.

Embodiment 56: The method of embodiment 55, wherein the second set of cards comprises at least four cards.

Embodiment 57: The method of embodiment 55, wherein the second set of cards comprises four, five, or six cards.

Embodiment 58: The method of embodiment 55, wherein the aligned holes of the first set of cards can form a number from 0 to 9 and the aligned holes of the second set of cards can form a number from 0 to 9, such that the first set of cards and the second set of cards can be used to form a two digit number.

What is claimed is:

1. A magic kit comprising:

a set of cards, each card comprising a plurality of holes and an order marker, wherein the plurality of holes on each card are arranged in a different order, wherein when the set of cards are stacked on top of each other in a specific order, using the order marker on each card as a guide, only some holes of all the cards in the set align to form a pattern.

2. The magic kit of claim 1, wherein the set of cards comprises at least four cards.

3. The magic kit of claim 1, wherein the set of cards comprises four, five, or six cards.

4. The magic kit of claim 1, wherein the cards have a length from about 80 millimeters (mm) to about 90 mm and have a width from about 60 mm to about 70 mm.

5. The magic kit of claim 1, wherein the cards have a thickness from about 0.5 mm to about 1.5 mm.

6. The magic kit of claim 1, wherein the plurality of holes are substantially uniform in size.

7. The magic kit of claim 6, wherein the plurality of holes are uniform in size.

8. The magic kit of claim 1, wherein the holes are laser cut in the cards.

9. The magic kit of claim 1, wherein each card has a minimum of 40 holes.

10. The magic kit of claim 1, wherein each card has about 40 holes to about 80 holes.

11. The magic kit of claim 1, wherein each card in the set has a different number of holes than the other cards in the set.

12. The magic kit of claim 1, wherein each card in the set has the same number of holes as the other cards in the set.

13. The magic kit of claim 12, wherein each card has 66 holes.

14. The magic kit of claim 1, wherein the holes have a polygonal shape.

15. The magic kit of claim 1, wherein the holes have the shape of a circle, oval, square, triangle, pentagon, hexagon, heptagon, or octagon.

16. The magic kit of claim 1, wherein each of the plurality of holes has the shape of a circle and a diameter from about 1 mm to about 5 mm.

17. The magic kit of claim 1, wherein the holes have a thickness from about 0.5 mm to about 1.5 mm.

18. The magic kit of claim 1, wherein the holes have a length from about 1 mm to about 5 mm, a width from about 1 mm to about 5 mm, and a thickness from about 0.5 mm to about 1.5 mm.

19. The magic kit of claim 1, wherein each card is comprised of a material that is not light transparent.

20. The magic kit of claim 1, wherein the cards are made of acrylic.

21. The magic kit of claim 1, wherein each card is opaque and blocks light from traveling through it in the areas devoid of holes or not fully aligned holes.

22. The magic kit of claim 1, wherein the pattern has the appearance of a number from 0 to 9.

23. The magic kit of claim 22, wherein the pattern has the appearance of a number from 1 to 9.

24. The magic kit of claim 1, wherein rotating one or more cards 180 degrees about a center axis when stacked changes the pattern of the aligned holes.

25. The magic kit of claim 1, wherein if the cards are not stacked in the specific order, no holes will align.

26. The magic kit of claim 1, further comprising a second set of cards.

27. The magic kit of claim 26, wherein the second set of cards comprises at least four cards.

28. The magic kit of claim 26, wherein the second set of cards comprises four, five, or six cards.

29. The magic kit of claim 26, wherein the aligned holes of the first set of cards can form a number from 0 to 9 and the aligned holes of the second set of cards can form a number from 0 to 9, such that the first set of cards and the second set of cards can be used to form a two digit number.

* * * * *